US010173852B2

(12) United States Patent
Yamaguchi

(10) Patent No.: US 10,173,852 B2
(45) Date of Patent: Jan. 8, 2019

(54) SHEET FEEDER AND IMAGE FORMING APPARATUS THAT ENSURE STABILIZED SHEET CONVEYANCE

(71) Applicant: Kyocera Document Solutions Inc., Osaka (JP)

(72) Inventor: Yoshihiro Yamaguchi, Osaka (JP)

(73) Assignee: Kyocera Document Solutions Inc., Osaka (JP)

( * ) Notice: Subject to any disclaimer, the term of this patent is extended or adjusted under 35 U.S.C. 154(b) by 2 days.

(21) Appl. No.: 15/789,961

(22) Filed: Oct. 21, 2017

(65) Prior Publication Data

US 2018/0111772 A1 Apr. 26, 2018

(30) Foreign Application Priority Data

Oct. 21, 2016 (JP) ..... 2016-206674

(51) Int. Cl.

| | |
|---|---|
| ***B65H 1/12*** | (2006.01) |
| ***B65H 1/14*** | (2006.01) |
| ***B41J 11/00*** | (2006.01) |
| ***B65H 1/04*** | (2006.01) |
| ***B65H 1/20*** | (2006.01) |
| ***B65H 1/26*** | (2006.01) |
| ***B65H 3/06*** | (2006.01) |
| ***G03G 15/00*** | (2006.01) |
| *B65H 31/18* | (2006.01) |
| *B65H 31/14* | (2006.01) |

(52) U.S. Cl.

CPC ..... *B65H 1/14* (2013.01); *B41J 11/00* (2013.01); *B65H 1/04* (2013.01); *B65H 1/12* (2013.01); *B65H 1/20* (2013.01); *B65H 1/266* (2013.01); *B65H 3/0684* (2013.01); *G03G 15/6511* (2013.01); *B65H 31/14* (2013.01); *B65H 31/18* (2013.01); *B65H 2403/544* (2013.01); *B65H 2405/15* (2013.01); *B65H 2405/353* (2013.01); *B65H 2801/06* (2013.01)

(58) Field of Classification Search

CPC ... B65H 1/12; B65H 1/14; B65H 1/20; B65H 31/18; B65H 31/14; B65H 2405/353

See application file for complete search history.

(56) References Cited

U.S. PATENT DOCUMENTS 5,294,105 A * 3/1994 Kaburagi ..... G01D 15/28 271/157
8,714,543 B2 * 5/2014 Matsushima ..... B65H 1/14 271/147

(Continued)

*Primary Examiner* — Howard J Sanders
(74) *Attorney, Agent, or Firm* — HEA Law PLLC

(57) ABSTRACT

A sheet feeder includes an apparatus main body, a sheet housing unit, and a sheet feeding unit. The sheet housing unit includes a housing space, a lift plate, an elevating mechanism, and a side fence. The elevating mechanism includes a pair of first wires, a pair of second wires, first pulleys, second pulleys, a reel, and a pair of first connecting members. The reel winds up the pair of first wires and the pair of second wires. The pair of first connecting members are connected to be relatively movable with respect to the lift plate in a vertical direction, causes a relative position to vary with respect to the lift plate in a vertical direction in accordance with a weight of the plurality of sheets loaded on the lift plate, and causes the lift plate to move upward when the weight is lighter than a predetermined value.

7 Claims, 10 Drawing Sheets

(56) References Cited

U.S. PATENT DOCUMENTS

| | | | | |
|---|---|---|---|---|
| 8,783,677 | B2 * | 7/2014 | Matsushima | B65H 1/14<br>271/147 |
| 2011/0024970 | A1 * | 2/2011 | Uchida | B65H 1/14<br>271/10.16 |

* cited by examiner

SHEET FEEDER AND IMAGE FORMING APPARATUS THAT ENSURE STABILIZED SHEET CONVEYANCE

INCORPORATION BY REFERENCE

This application is based upon, and claims the benefit of priority from, corresponding Japanese Patent Application No. 2016-206674 filed in the Japan Patent Office on Oct. 21, 2016, the entire contents of which are incorporated herein by reference.

BACKGROUND

Unless otherwise indicated herein, the description in this section is not prior art to the claims in this application and is not admitted to be prior art by inclusion in this section.

As a typical large-capacity sheet feeder, there is known the following sheet feeder.

The sheet feeder feeds a sheet located at an uppermost position of a sheet bundle that is housed in a sheet housing unit and has a plurality of sheets to an image forming apparatus by a sheet feeding unit arranged in a downstream side of a paper feeding direction of the sheet housing unit. The sheets housed in the sheet housing unit are loaded on a lift plate that moves up and down inside the sheet housing unit. The lift plate is suspended by wires and moves up by winding up the wires using a reel located at a motor shaft.

The wires include a pair of upstream-side wires that suspend end portions of the lift plate in an upstream side of the paper feeding direction at both sides of a direction perpendicular to the paper feeding direction and a pair of downstream-side wires that suspend positions of the lift plate in a downstream side of the paper feeding direction with respect to the ends positions in the upstream side at both sides of the direction perpendicular to the paper feeding direction. The pair of upstream-side wires is looped over a pair of upstream-side pulleys arranged vertically above the end portions of the lift plate in the upstream side. The pair of downstream-side wires is looped over a pair of downstream-side pulleys arranged vertically above the end portions in downstream side. Between the upstream-side pulleys and the downstream-side pulleys, side fences are located to position side ends of the sheet bundle along the paper feeding direction.

The sheet housing unit includes a pair of sidewalls opposed to a direction perpendicular to the paper feeding direction. At the downstream side of the paper feeding direction of the pair of sidewalls, a stepped portion having a height lower than an upper end of the pair of sidewalls is formed. A pickup roller of the sheet feeding unit is arranged at the position of the stepped portion. The upstream-side pulleys and the downstream-side pulleys are arranged in the upstream side of the paper feeding direction with respect to a position of the pickup roller of the sheet housing unit and are arranged at a height identical to the pickup roller such that the uppermost sheet loaded on the lift plate can abut on the pickup roller.

SUMMARY

A sheet feeder according to one aspect of the disclosure includes an apparatus main body, a sheet housing unit, and a sheet feeding unit. The sheet housing unit is insertably and removably located on the apparatus main body. The sheet housing unit houses a plurality of sheets. The sheet feeding unit extracts a sheet located at an uppermost position in the plurality of sheets in a first direction. The sheet housing unit includes a housing space, a lift plate, an elevating mechanism, and a side fence. The housing space has an opening in an upper side. The housing space is defined by a bottom portion, a pair of first sidewalls that is located upright from the bottom portion and are mutually opposed in a second direction perpendicular to the first direction, and a pair of second sidewalls mutually opposed in the first direction. The lift plate is loaded with the plurality of sheets. The lift plate moves up and down inside the housing space. The elevating mechanism causes the lift plate to move up and down. The side fence is located upright from the bottom portion. The side fence abuts on a side end of the plurality of sheets along the first direction. The elevating mechanism includes a pair of first wires, a pair of second wires, a pair of first pulleys, a pair of second pulleys, a reel, and a pair of first connecting members. The pair of first wires is located outside the pair of first sidewalls in the second direction. The pair of first wires suspends end portions in a downstream side of the first direction of the lift plate at both sides in the second direction of the lift plate. The pair of second wires is located outside the pair of first sidewalls in the second direction. The pair of second wires suspends end portions in an upstream side of the first direction of the lift plate at both sides in the second direction of the lift plate. The pair of first wires is laid across the pair of first pulleys. The pair of second wires is laid across the pair of second pulleys. The reel winds up the pair of first wires and the pair of second wires. The pair of first connecting members connect the end portions in the downstream side of the first direction of the lift plate to the first wires. The pair of first connecting members are connected to be relatively movable with respect to the lift plate in a vertical direction, causes a relative position to vary with respect to the lift plate in a vertical direction in accordance with a weight of the plurality of sheets loaded on the lift plate, and causes the lift plate to move upward when the weight is lighter than a predetermined value.

These as well as other aspects, advantages, and alternatives will become apparent to those of ordinary skill in the art by reading the following detailed description with reference where appropriate to the accompanying drawings. Further, it should be understood that the description provided in this summary section and elsewhere in this document is intended to illustrate the claimed subject matter by way of example and not by way of limitation.

DETAILED DESCRIPTION

Figure 1:
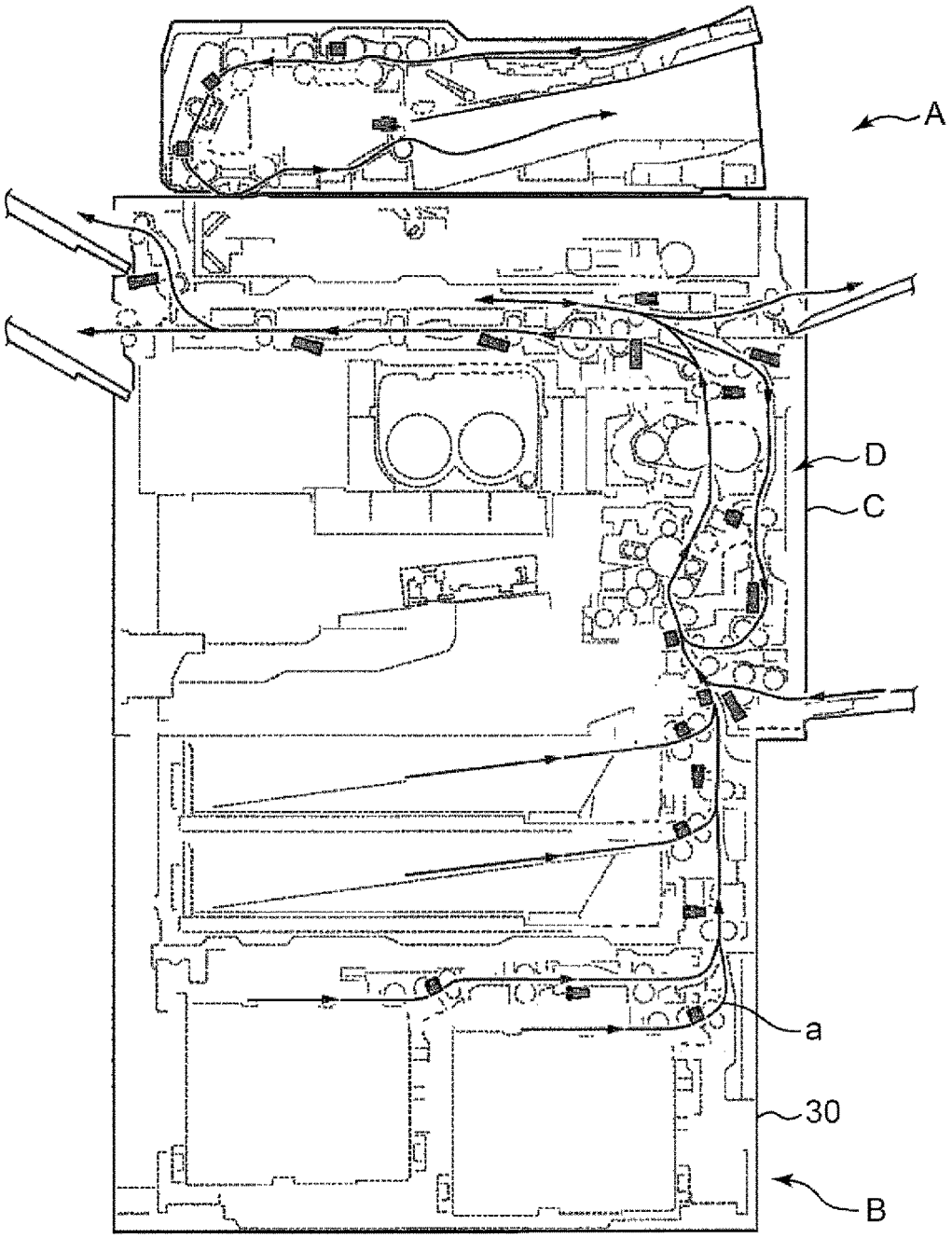
FIG. 1 illustrates a cross-sectional view illustrating an image forming apparatus that includes a sheet feeder according to one embodiment of the disclosure.

Example apparatuses are described herein. Other example embodiments or features may further be utilized, and other changes may be made, without departing from the spirit or scope of the subject matter presented herein. In the following detailed description, reference is made to the accompanying drawings, which form a part thereof.

The example embodiments described herein are not meant to be limiting. It will be readily understood that the aspects of the present disclosure, as generally described herein, and illustrated in the drawings, can be arranged, substituted, combined, separated, and designed in a wide variety of different configurations, all of which are explicitly contemplated herein.

Figure 2:
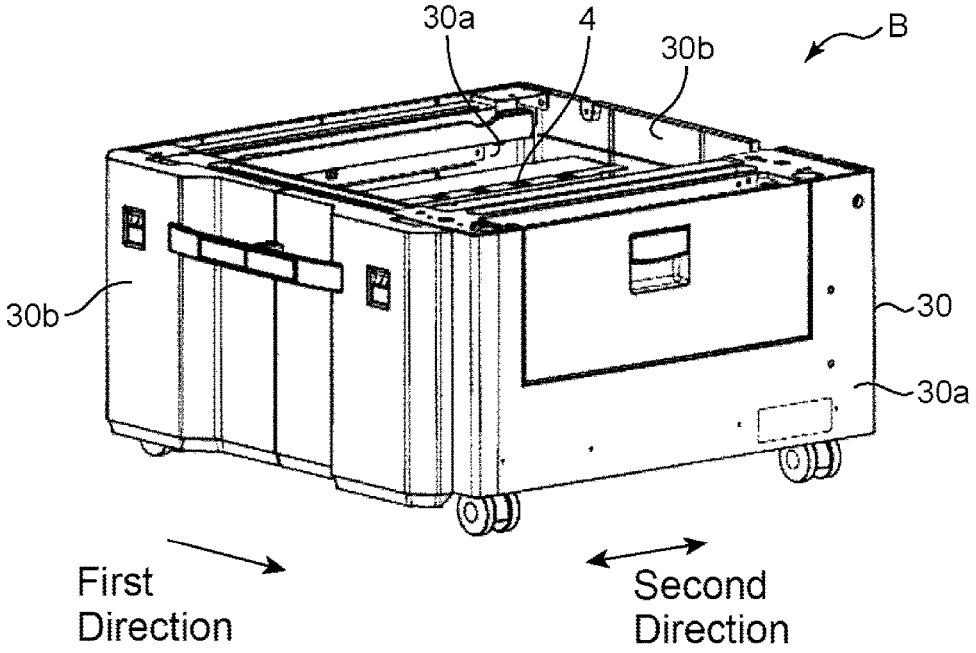
FIG. 2 illustrates a perspective view illustrating the sheet feeder according to the one embodiment.
Figure 3:
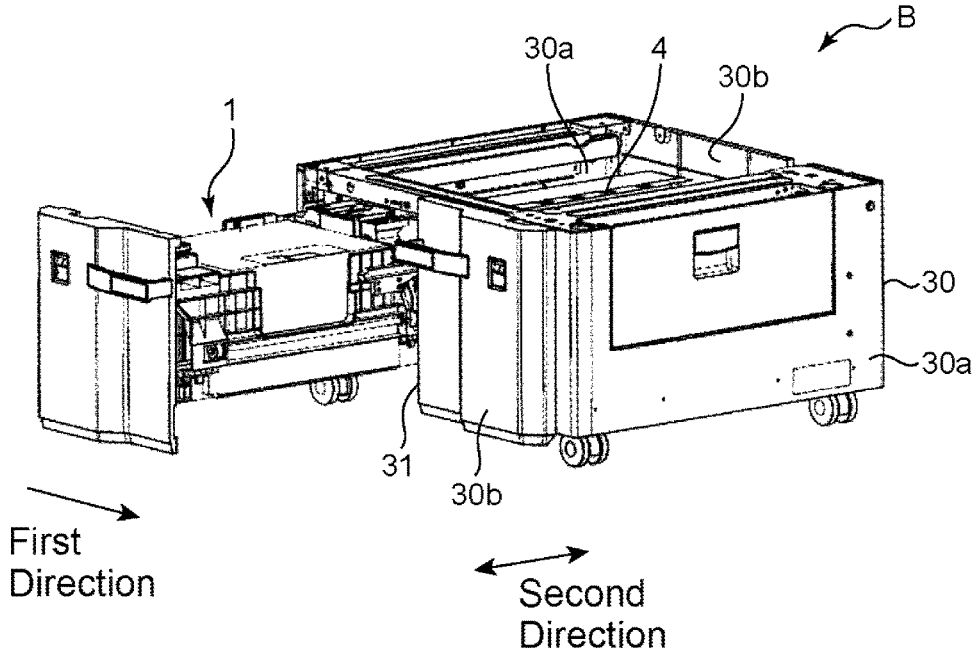
FIG. 3 illustrates another perspective view illustrating the sheet feeder according to the one embodiment.

FIG. 1 illustrates a cross-sectional view illustrating an image forming apparatus A that includes an exemplary sheet feeder B. FIG. 2 illustrates a perspective view illustrating the exemplary sheet feeder B. FIG. 3 illustrates another perspective view illustrating the exemplary sheet feeder B. The image forming apparatus A includes a main unit C that houses various kinds of devices, the sheet feeder B that is mounted at a lower end of the main unit C, and an image forming unit D that forms an image on a sheet fed from the sheet feeder B.

The sheet feeder B includes an apparatus main body 30, a sheet housing unit 1, and a sheet feeding unit 4. The apparatus main body 30 is mounted to a lower end portion of the main unit C. The sheet housing unit 1 houses a sheet bundle having a plurality of sheets. The sheet feeding unit 4 extracts a sheet located at an uppermost position of the sheet bundle in a first direction and feeds it to the image forming unit D. The first direction denotes a direction toward a sheet conveyance path a of the image forming apparatus A from the sheet feeder B, namely a paper feeding direction. When simply described as a downstream side in the description, the downstream side means the downstream side in the paper feeding direction. When simply described as an upstream side in the description, the upstream side means the upstream side of a direction opposite to the paper feeding direction.

The apparatus main body 30 is formed in a box shape having an opening in an upper side. The apparatus main body 30 has a pair of first sidewall portions 30*a* opposed to the first direction and a pair of second sidewall portions 30*b* opposed to a second direction perpendicular to the first direction. One of the second sidewall portions 30*b* has an opening 31, as illustrated in FIG. 3. The apparatus main body 30 includes the sheet housing unit 1 that is insertably and removably located in the second direction through the opening 31.

Figure 4:
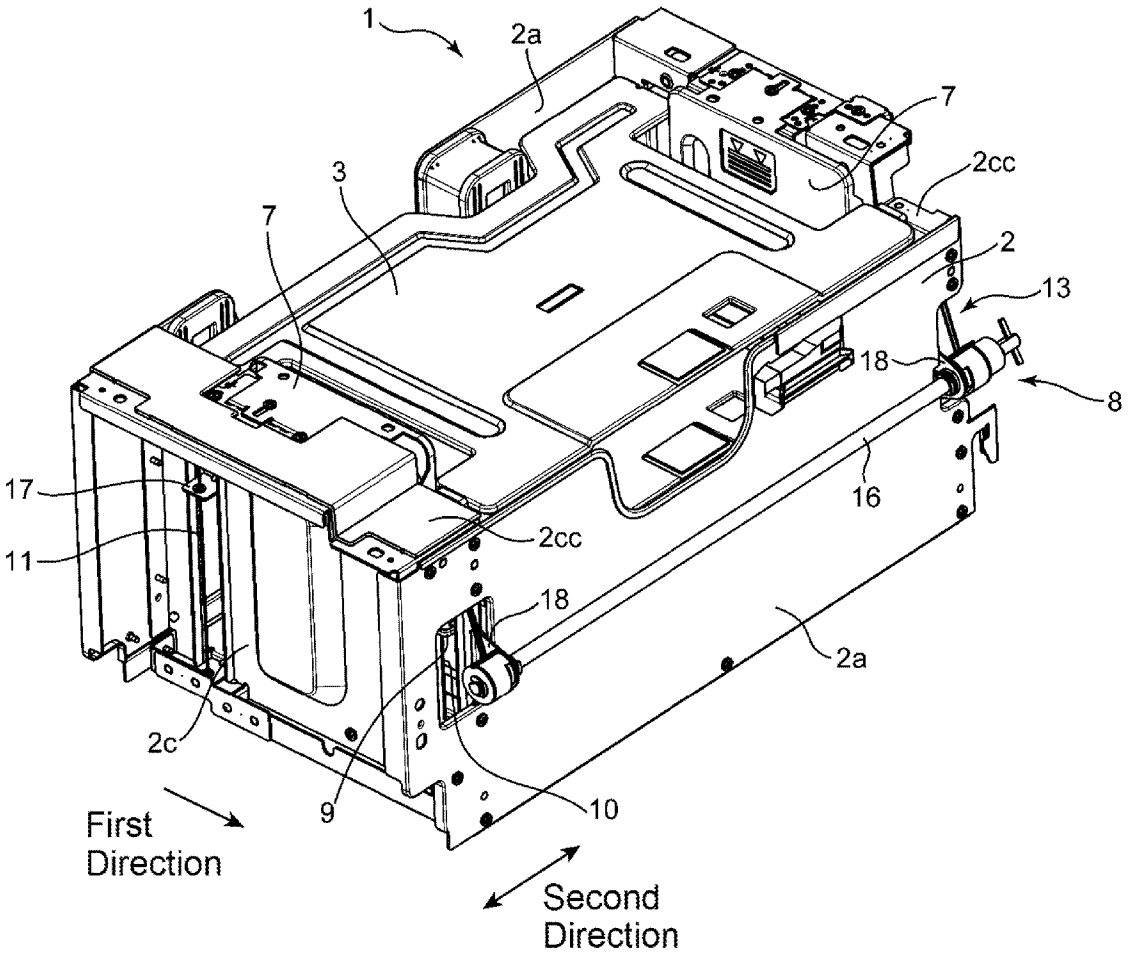
FIG. 4 illustrates a perspective view illustrating a sheet housing unit of the sheet feeder according to the one embodiment.
Figure 5:
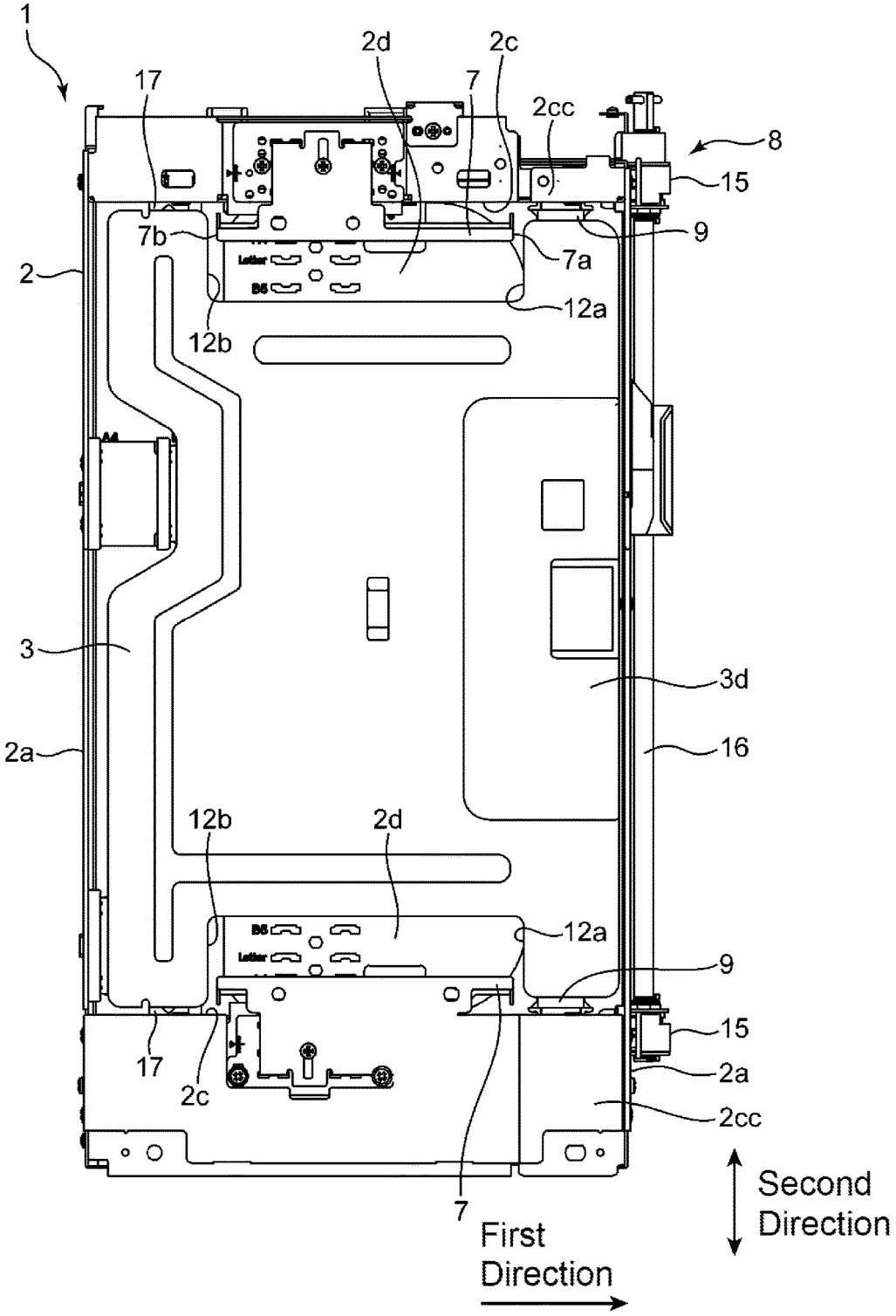
FIG. 5 illustrates a plan view illustrating the sheet housing unit of the sheet feeder according to the one embodiment.
Figure 6:
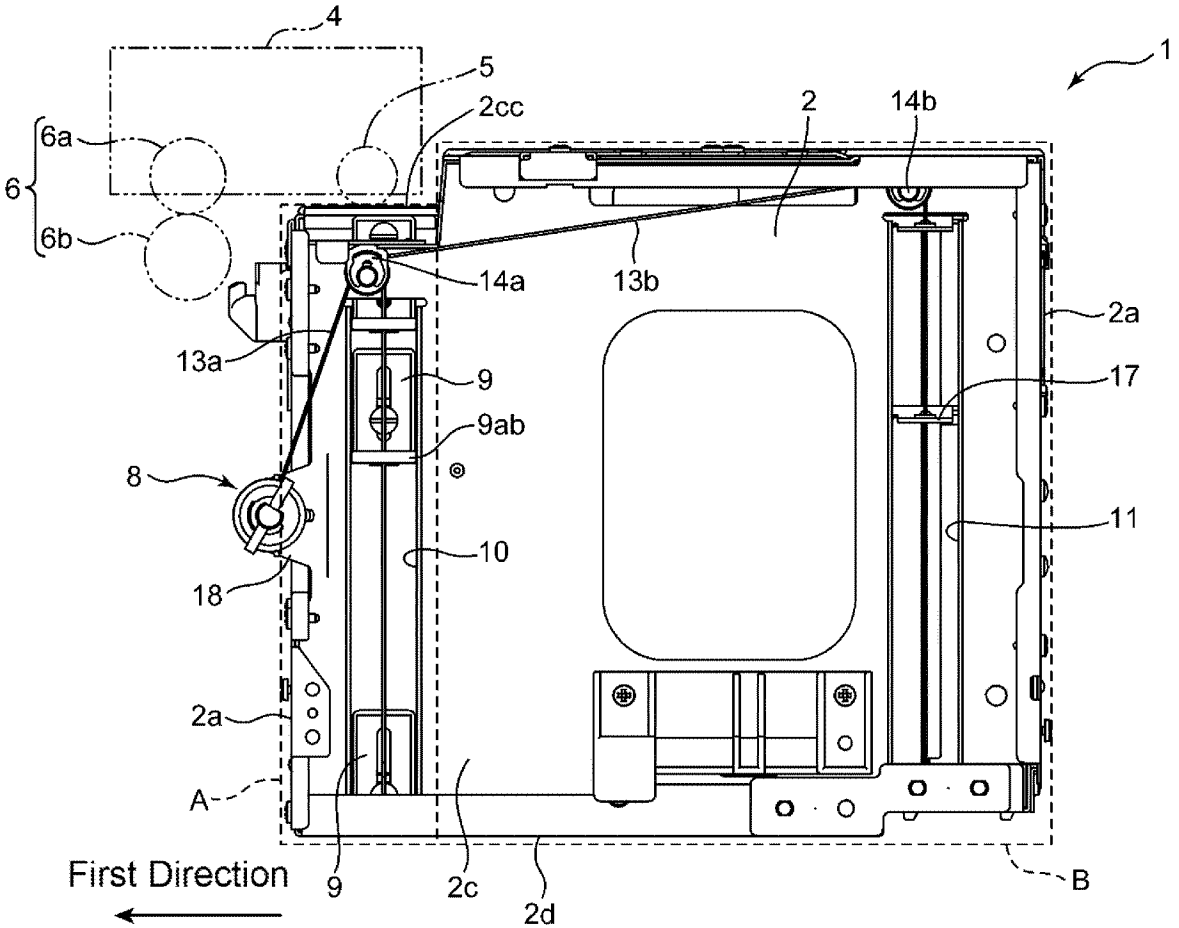
FIG. 6 illustrates a right-side view illustrating the sheet housing unit of the sheet feeder according to the one embodiment.

FIG. 4 illustrates a perspective view illustrating the exemplary sheet housing unit 1. FIG. 5 illustrates a plan view illustrating the exemplary sheet housing unit 1. FIG. 6 illustrates a right-side view illustrating the exemplary sheet housing unit 1. The sheet housing unit 1 includes a housing portion 2, a lift plate 3, an elevating mechanism 8, and side fences 7. The housing portion 2 houses the sheets. The lift plate 3 is loaded with a sheet bundle having a plurality of sheets and moves up and down inside the housing portion 2. The side fences 7 abut on side ends of the sheet bundle along the first direction.

The housing portion 2 is formed in a box shape having an opening in an upper side. The housing portion 2 has a bottom portion 2*d*, a pair of first sidewalls 2*c*, a pair of second sidewalls 2*a*, and a housing space. The pair of first sidewalls 2*c* is located upright from the bottom portion 2*d* and is mutually opposed in the second direction. The pair of second sidewalls 2*a* is mutually opposed in the first direction. The housing space is defined by the bottom portion 2*d*, the pair of first sidewalls 2*c*, and the pair of second sidewalls 2*a*. The pair of first sidewalls 2*c* includes stepped portions 2*cc* having a height lower than a height of their upper ends. The stepped portions 2*cc* are arranged in a downstream side of the first direction. While being opposed to the housing space, the sheet feeding unit 4 located in the apparatus main body 30 is arranged at a height position of the stepped portions 2*cc* (see FIGS. 2 and 6). As illustrated in FIG. 3, this enables an operator to avoid interference of the sheet housing unit 1 and the sheet feeding unit 4 when mounting the sheet housing unit 1 into the apparatus main body 30 along the second direction.

The housing portion 2 is partitioned into a first part A and a second part B, as illustrated in FIG. 6, viewed from the second direction. The first part A occupies a downstream portion of the first direction, namely, a portion that vertically overlaps with the sheet feeding unit 4. The second part B occupies an upstream portion with respect to the position of the stepped portions 2*cc*.

The pair of second sidewalls 2*a* has rectangular-shaped first openings 10 extending downward from an upper portion of the first part A up to the bottom portion 2*d*. The pair of first sidewalls 2*c* has rectangular-shaped second openings 11 extending downward from the upstream side of the first direction in the upper portion of the second part B up to the bottom portion 2*d*.

The sheet feeding unit 4 is located above end portions in the downstream side of the first direction of the lift plate 3. The sheet feeding unit 4 includes a pickup roller 5, and a feed roller pair 6. The pickup roller 5 delivers the uppermost sheet of the sheet bundle one by one. The feed roller pair 6 sends out the sheets to the sheet conveyance path a. The feed roller pair 6 is constituted of a feed roller 6*a* and a retard roller 6*b* that separates and conveys the sheets one by one with the feed roller 6*a*. As illustrated in FIG. 6, the pickup roller 5 is arranged at a position in contact with an upper end of the first part A viewed from the second direction (the direction perpendicular to the paper surface in FIG. 6). The pickup roller 5 delivers the sheets to the sheet conveyance path a in abutting contact with the top surface of the uppermost sheet loaded on the lift plate 3. First pulleys 14*a* can be located vertically below the pickup roller 5 on the first sidewalls 2*c* viewed from the second direction.

Since the first pulleys 14*a* are located vertically below the pickup roller 5 on the first sidewalls 2*c* viewed from the second direction, this configuration ensures a wide space in the upstream side of the first direction of the first pulleys 14*a* inside the housing space. Consequently, this enables a length of the side fences 7 in the first direction (the paper feeding direction) to be set longer and ensures reduction of skew of the sheets.

Figure 7:
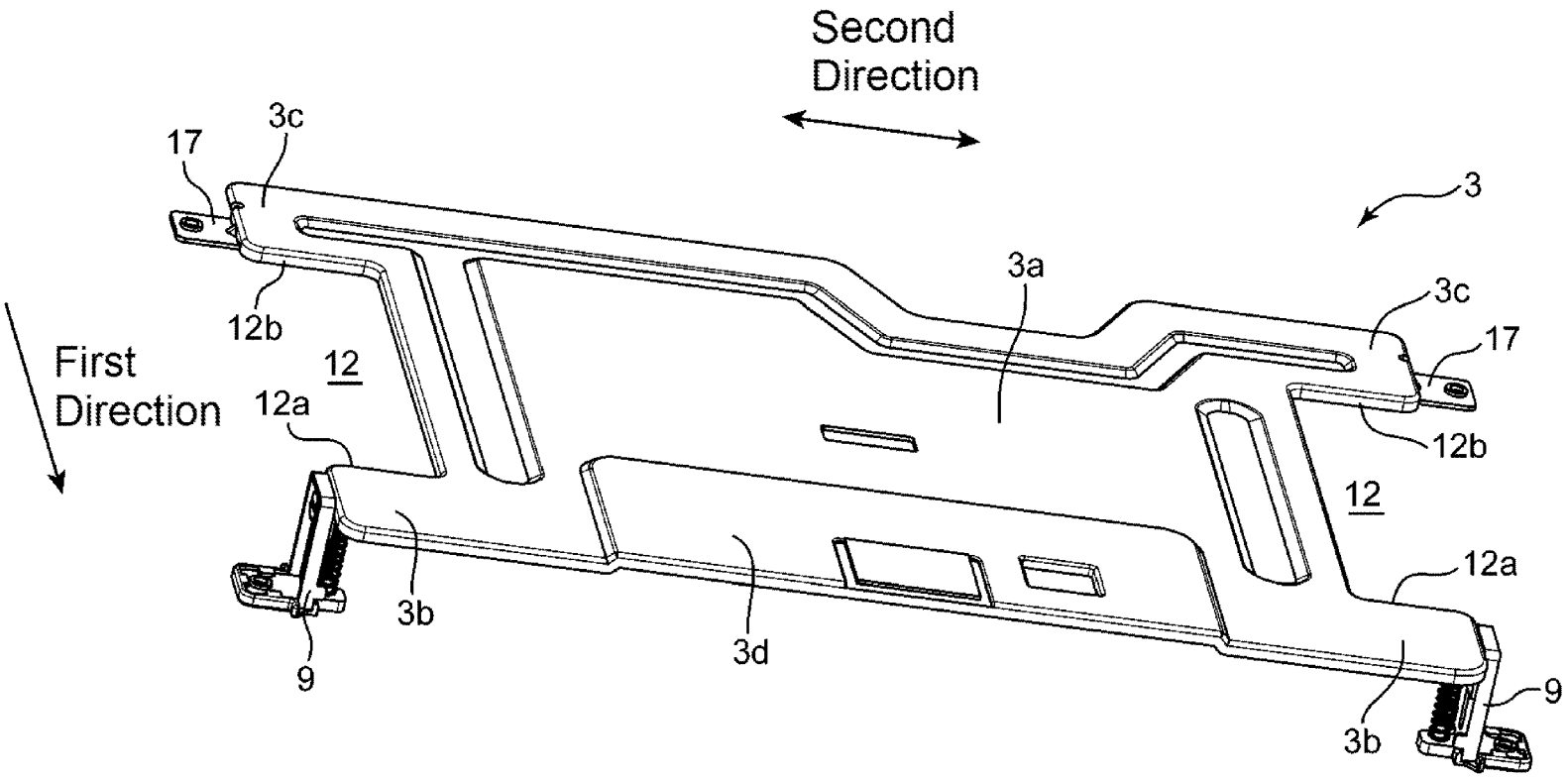
FIG. 7 illustrates a perspective view illustrating a lift plate of the sheet housing unit of the sheet feeder according to the one embodiment.

FIG. 7 illustrates a perspective view illustrating the exemplary lift plate 3 of the sheet housing unit 1. The lift plate 3 includes an approximately rectangular-shaped sheet placement portion 3*a* and first flange portions 3*b*. The sheet placement portion 3*a* supports the sheet bundle. The first flange portions 3*b* project in the second direction from second-direction side edges of downstream-side corner portions in the corner portions of the sheet placement portion 3*a*. The lift plate 3 includes second flange portions 3*c* that project in the second direction from second-direction side edges of upstream-side corner portions in the corner portions of the sheet placement portion 3*a*, at positions spaced from the first flange portions 3*b* toward the upstream side. The first flange portions 3*b* are arranged in the first part A of the housing portion 2. The second flange portions 3*c* are arranged in the second part B of the housing portion 2. At a downstream-side end portion in the first direction of the sheet placement portion 3*a*, a friction plate 3*d* that is vertically opposed to the pickup roller 5 of the sheet feeding unit 4 is attached (see FIGS. 5 to 7).

Between the first flange portions 3*b* and the second flange portions 3*c*, depressed regions 12 are formed. By referring to FIG. 5, downstream-side side edges 12*a* of the depressed regions 12 are at a boundary of the first part A and the second part B of the housing portion 2. Upstream-side side edges 12*b* of the depressed regions 12 are at proximity of the second sidewalls 2*a* in the upstream side of the first direction. The side fences 7 are arranged inside the depressed regions 12. The side fences 7 are formed in a rectangular shape. The side fences 7 are arranged to be opposed to the first sidewalls 2*c* of the housing portion 2. Downstream-side side edges 7*a* of the side fences 7 reach proximity of the downstream-side side edges 12*a* of the depressed regions 12. Upstream-side side edges 7*b* of the side fences 7 reach proximity of the upstream-side side edges 12*b* of the depressed regions 12. The side fences 7 are displaceable in the second direction inside the depressed regions 12 and can regulate the positions of the side ends of the sheet bundle. While the side fences 7 are entirely located in the second part B of the housing portion 2, the downstream-side side edges 7*a* in the first direction may be located in the downstream side of the housing portion 2, namely, inside the first part A of the housing portion 2. The depressed regions 12 are exemplified as a cut-out portion.

Figure 8:
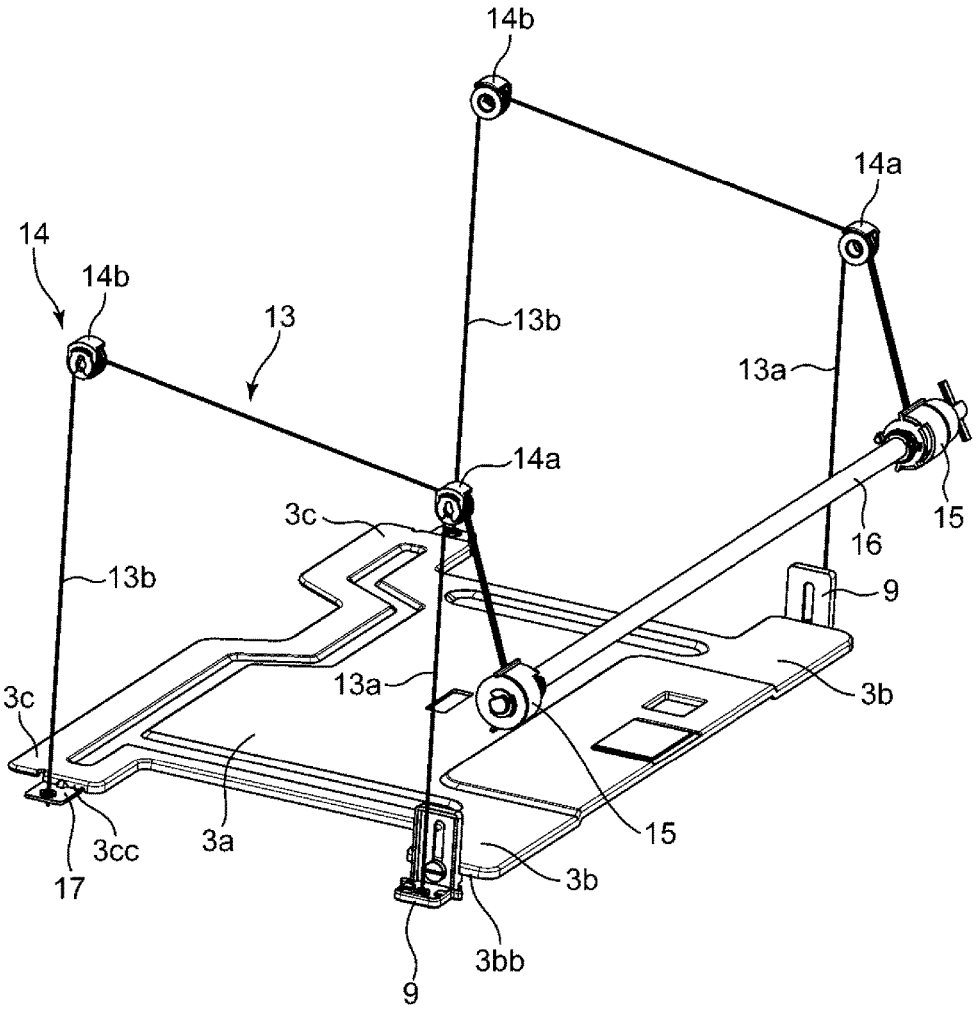
FIG. 8 illustrates a perspective view illustrating an elevating mechanism of the sheet housing unit of the sheet feeder according to the one embodiment.

FIG. 8 illustrates a perspective view illustrating the exemplary elevating mechanism 8 of the sheet housing unit 1. The elevating mechanism 8 includes four wires 13, four pulleys 14, two reels 15, a rotation shaft 16, and a pair of connecting members (first connecting members) 9. The four wires 13 suspend the lift plate 3. The four wires 13 are each laid over the four pulleys 14. The two reels 15 wind up the four wires 13. The rotation shaft 16 is inserted into the two reels 15. The connecting members 9 connect the lift plate 3 and the wires 13.

The four wires 13 include a pair of first wires 13*a* and a pair of second wires 13*b*. The pair of first wires 13*a* is connected to the connecting members 9 mounted to second-direction side edges 3*bb* of the first flange portions 3*b*. The pair of second wires 13*b* is connected to a pair of mounting pieces (second connecting members) 17 mounted to second-direction side edges 3*cc* of the second flange portions 3*c*. The four pulleys 14 include a pair of first pulleys 14*a* and a pair of second pulleys 14*b*. The pair of first pulleys 14*a* is arranged at positions directly extending upward from mounting positions of the pair of first wires 13*a* at the connecting members 9. The pair of second pulleys 14*b* is arranged at positions directly extending upward from mounting positions of the pair of second wires 13*b* at the mounting pieces 17. The mounting pieces 17 project in the second direction so as to pass through the second openings 11 of the housing portion 2 from the second-direction side edges 3*cc* of the second flange portions 3*c*. The mounting pieces 17 vertically move in the second openings 11 in accordance with elevation of the lift plate 3.

By referring to FIG. 6, the pair of first pulleys 14*a* is located outside the pair of first sidewalls 2*c* of the housing portion 2 in the second direction. The pair of first pulleys 14*a* is mounted between the first openings 10 and the pickup roller 5. This arranges the pair of first pulleys 14*a* in the first part A. The pair of second pulleys 14*b* is located outside the pair of first sidewalls 2*c* of the housing portion 2 in the second direction. The pair of second pulleys 14*b* is mounted above the second openings 11. The pair of second pulleys 14*b* is located at a position higher than that of the first pulleys 14*a*. The two reels 15 are mounted to projecting pieces 18. The projecting pieces 18 project to the downstream side from a center portion in the vertical direction of the downstream-side side edges of the second sidewalls 2*a* in the downstream side of the first direction.

The pair of first wires 13*a* is laid across the pair of first pulleys 14*a* and connects the reels 15 and the connecting members 9. This arranges the pair of first wires 13*a* outside the second direction of the pair of first sidewalls 2*c*. The pair of second wires 13*b* is laid across the pair of first pulleys 14*a* and the pair of second pulleys 14*b* and connects the reels 15 and the mounting pieces 17. This arranges the pair of second wires 13*b* outside the second direction of the pair of first sidewalls 2*c*.

The rotation shaft 16 is connected to a motor (not illustrated) located in the image forming apparatus A. In accordance with this, driving the motor causes the rotation shaft 16 to rotate and causes the reels 15 to wind up the first wires 13*a* via the first pulleys 14*a* and wind up the second wires 13*b* via the second pulleys 14*b* and the first pulleys 14*a*. As a result, the lift plate 3 is raised. Releasing connection of the rotation shaft 16 and the motor causes the rotation shaft 16 to reversely rotate due to a weight of the lift plate 3 and the sheets loaded on the lift plate 3, and thus causes the reels 15 to reel out the first wires 13*a* and the second wires 13*b*. Consequently, the lift plate 3 moves up and down in the pair of first sidewalls 2*c* of the housing portion 2.

Figure 9:
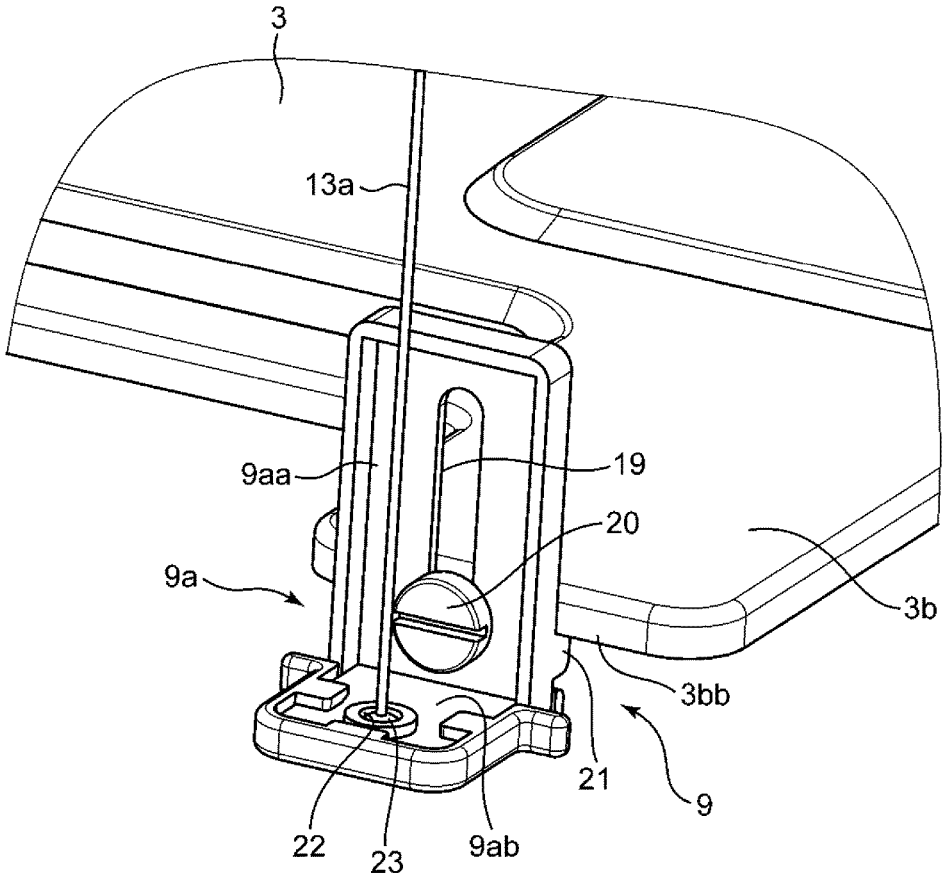
FIG. 9 illustrates a perspective view illustrating a connecting member of the elevating mechanism of the sheet housing unit of the sheet feeder according to the one embodiment.
Figure 10:
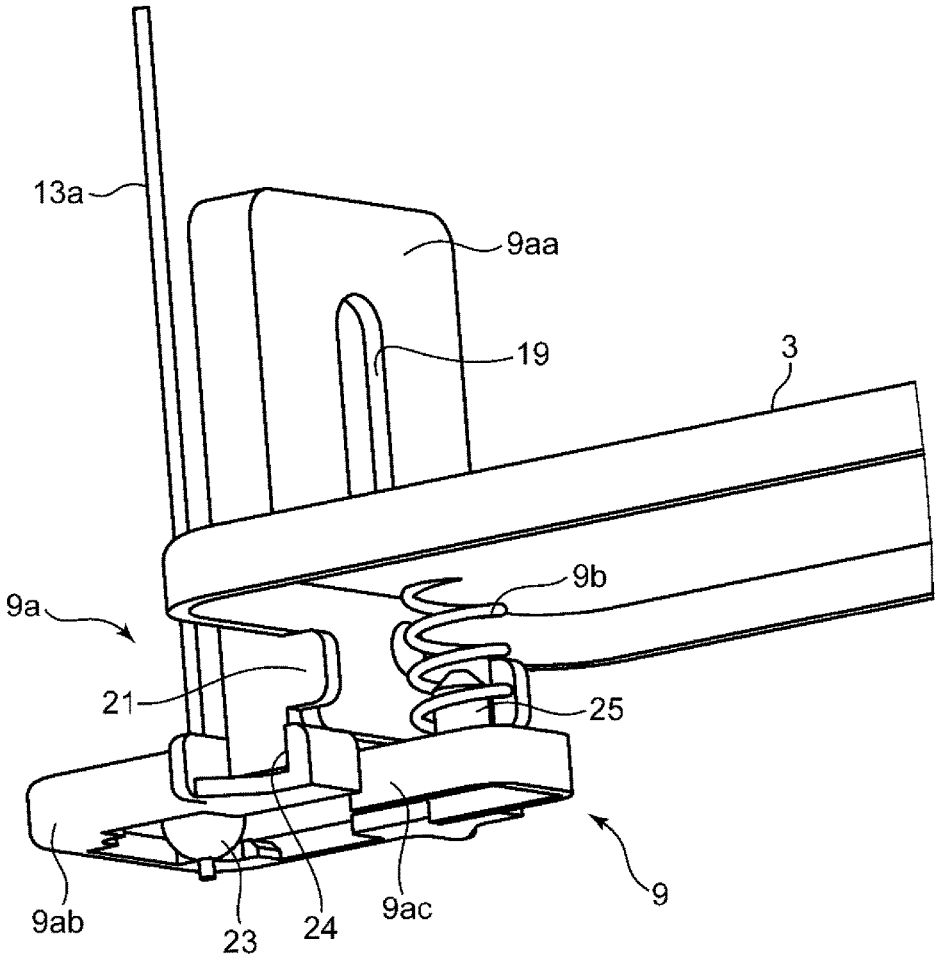
FIG. 10 illustrates another perspective view illustrating the connecting member of the elevating mechanism of the sheet housing unit of the sheet feeder according to the one embodiment.

FIG. 9 illustrates a perspective view illustrating the exemplary connecting member 9 of the elevating mechanism 8 of the sheet housing unit 1. FIG. 10 illustrates another perspective view illustrating the exemplary connecting member 9 of the elevating mechanism 8 of the sheet housing unit 1. The connecting members 9 are arranged vertically below the first pulleys 14*a* (see FIGS. 6 and 8). The connecting member 9 includes a wire connecting member 9*a* and a biasing member 9*b*. The wire connecting member 9*a* is mounted to the lift plate 3 to be relatively movable in a vertical direction with respect to the lift plate 3. The biasing member 9*b* is located between the wire connecting member 9*a* and the lift plate 3 and biases the lift plate 3 upward.

The wire connecting member 9*a* includes a rectangular-shaped mounting portion 9*aa*, a flat-plate-shaped wire connecting portion 9*ab*, and a flat-plate-shaped spring-securing portion 9*ac*. The mounting portion 9*aa* includes a guide groove 19 extending in the vertical direction. The wire connecting portion 9*ab* extends outward or in a direction separating from the lift plate 3 from the lower end of the mounting portion 9*aa*. The spring-securing portion 9*ac* extends inward or in a direction opposite to the wire connecting portion 9*ab* and secures the biasing member 9*b*.

A connection pin 20 secured to the second-direction side edge 3*bb* of the first flange portion 3*b* is inserted into the guide groove 19 of the mounting portion 9*aa*. The connection pin 20 is swaged in its distal end. This enables the mounting portion 9*aa* to be mounted to the first flange portion 3*b*. Protruding portions 21, which abut on a lower surface of the first flange portion 3*b*, are formed below the guide groove 19 of the mounting portion 9*aa*. The connection pin 20 includes, for example, a screw or a pin.

The wire connecting portion 9*ab* projects from the first opening 10 of the housing portion 2 and vertically moves in the first opening 10 in accordance with the elevation of the lift plate 3 (see FIGS. 4 and 6). The wire connecting portion 9*ab* has a through-hole 22 into which the first wire 13*a* is inserted. A ball 23 that is mounted to a distal end of the first wire 13*a*, which is inserted into the through-hole 22, is arranged on a backside surface of the wire connecting portion 9*ab*. The ball 23 has a diameter larger than an inside diameter of the through-hole 22 and thus does not enter the through-hole 22. This connects the first wire 13*a* to the wire connecting portion 9*ab*. The wire connecting portion 9*ab* has a depressed groove 24 into which the lower end portion of the mounting portion 9*aa* fits. Fitting the lower end portion of the mounting portion 9*aa* into the depressed groove 24 secures the wire connecting portion 9*ab* to the mounting portion 9*aa*.

The spring-securing portion 9*ac* is integrally formed with the wire connecting portion 9*ab*. The spring-securing portion 9*ac* includes a projecting portion 25 projecting toward the first flange portion 3*b*.

The biasing member 9*b* is a compression coil spring. The compression coil spring is inserted into the projecting portion 25 to be mounted to the spring-securing portion 9*ac*. The biasing member 9*b* is compressed by the weight of the lift plate 3 and the sheets loaded on the lift plate 3, and gradually returns to its natural length by an elastic force when the weight of the sheets, which are loaded on the lift plate 3, becomes lighter than a predetermined value. This causes the connecting member 9 to vary the height position of the lift plate 3 inside the housing portion 2 in accordance with the weight of the sheet bundle loaded on the lift plate 3. The predetermined value is set such that the uppermost sheet loaded on the lift plate 3 can abut on the pickup roller 5. A biasing force of the biasing member 9*b* is designed so as to be sufficiently larger compared with a pressing load of the pickup roller 5. The biasing member 9*b* is not limited to a compression coil spring and may be any spring as long as it can bias the lift plate 3 upward.

Figure 11:
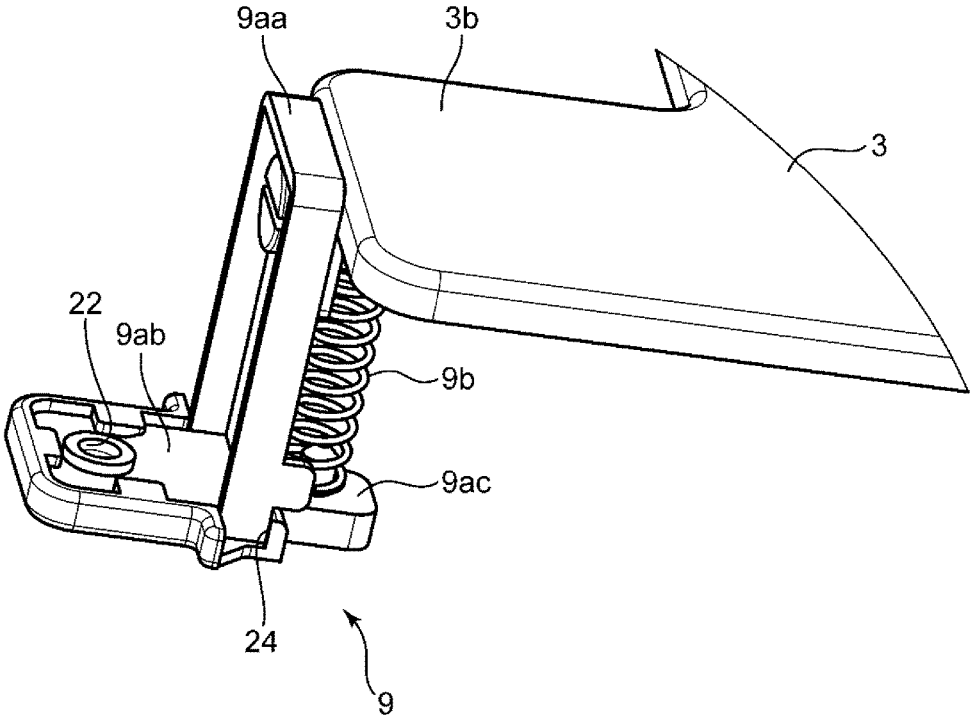
FIG. 11 illustrates a perspective view illustrating the connecting member when the lift plate of the sheet housing unit of the sheet feeder according to the one embodiment is at its uppermost position.

FIG. 11 illustrates a perspective view illustrating the connecting member 9 when the exemplary lift plate 3 of the sheet housing unit 1 is at the highest position. The sheet feeder B configured as described above operates as follows. First, when a large number of sheets are loaded on the lift plate 3, the lift plate 3 is at the lowest position with respect to the connecting member 9. That is, the connection pin 20 secured to the lift plate 3 contacts with the lower end of the guide groove 19 (see FIG. 9). When the number of sheets loaded on the lift plate 3 becomes small, the motor rotates and the lift plate 3 gradually rises to a position where the uppermost sheet contacts with the pickup roller 5.

When the lift plate 3 rises to a position where the wire connecting portions 9*ab* of the connecting members 9 nearly contact with the first pulleys 14*a*, the lift plate 3 halts. Subsequently, when the number of sheets further becomes small and the weight of the sheets becomes lighter than the predetermined value, the height position of the lift plate 3 becomes gradually higher with respect to the connecting members 9 by the biasing forces of the biasing members 9*b*. This causes the uppermost sheet, which is loaded on the lift plate 3, to maintain contact with the pickup roller 5 and to be fed by the sheet feeding unit 4.

When the sheet loaded on the lift plate 3 runs out, the lift plate 3 is at the highest position with respect to the connecting members 9. That is, the connection pins 20 secured to the lift plate 3 contact with the upper ends of the guide grooves 19. At this time, the top surface of the lift plate 3 coincides with the stepped portions 2*cc* of the pair of first sidewalls 2*c*. As described above, operation of the sheet housing unit 1 of the sheet feeder B causes the sheet feeding unit 4 to feed the sheets loaded on the lift plate 3.

The above-described sheet feeder B includes the connecting members 9 that vary the height position of the lift plate 3 inside the housing portion 2 in accordance with the weight of the sheet bundle loaded on the lift plate 3. Consequently, even when the first pulleys 14*a* are arranged in the first part A of the housing portion 2, the connecting members 9 ensures causing the uppermost sheet of the sheet bundle loaded on the lift plate 3 to abut on the pickup roller 5 and ensures paper feeding by the sheet feeding unit 4. This ensures a large loading capacity.

According to the above-described sheet feeder B, the downstream-side side edges 7*a* of the side fences 7 reach the proximity of the downstream-side side edges 12*a* of the depressed regions 12, and the upstream-side side edges 7*b* of the side fences 7 reach the proximity of the upstream-side side edges 12*b* of the depressed regions 12. Therefore, this ensures the long first-direction lengths of the side fences 7 and high stability of sheet conveyance.

According to the above-described sheet feeder B, when the sheet feeder B is removed from the image forming apparatus A, and the connection of the rotation shaft 16 of the elevating mechanism 8 and a motor is released, even when the lift plate 3 having the loaded sheets rapidly drops, compression of the biasing members 9*b* softens an impact of the dropping, and thus this ensures avoidance of a collision sound.

While in the above-described embodiment the connecting members 9 are mounted only to the first flange portions 3*b* among the first flange portions 3*b* and the second flange portions 3*c*, the connecting members 9 may be located to both the first flange portions 3*b* and the second flange portions 3*c*, and the second pulleys 14*b* may be arranged at a height position identical to the first pulleys 14*a*. Thus, because the second wires 13*b* become horizontal between the first pulleys 14*a* and the second pulleys 14*b*, the lift plate 3 can move up and down in a stable state. Even in this case, the above-described operations of the connecting members 9 ensure causing the sheets loaded on the lift plate 3 to abut on the pickup roller 5 and ensure causing the sheet feeding unit 4 to perform the paper feeding. In this case, to strongly press the sheets loaded on the lift plate 3 to the pickup roller 5, it is preferred that the biasing forces of the biasing members 9*b* of the connecting members 9 mounted to the first flange portions 3*b* be set stronger than the biasing forces of the biasing members 9*b* of the connecting members 9 mounted to the second flange portions 3*c*. When the second pulleys 14*b* are arranged at a height position identical to the first pulleys 14*a*, the connecting members 9 may be mounted to only the second flange portions 3*c*.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. A sheet feeder comprising:

an apparatus main body;

a sheet housing unit insertably and removably located on the apparatus main body, the sheet housing unit for housing a plurality of sheets, and a sheet feeding unit for extracting in a first direction a sheet located at an uppermost position in the plurality of sheets; wherein the sheet housing unit includes a housing space that has an opening in an upper side, the housing space being defined by a bottom portion, a pair of first sidewalls that is located upright from the bottom portion and are mutually opposed in a second direction perpendicular to the first direction, and a pair of second sidewalls mutually opposed in the first direction, a lift plate for carrying the plurality of sheets, the lift plate having downstream-side end portions along an edge of the lift plate that is sheet-feeding downstream in the first direction and having upstream-side end portions along an edge of the lift plate that is sheet-feeding upstream in the first direction, and the lift plate arranged for moving up and down inside the housing space, an elevating mechanism that causes the lift plate to move up and down, and a side fence located upright from the bottom portion, the side fence abutting on a side end of the plurality of sheets along the first direction;

the sheet feeding unit is arranged in the apparatus main body on an upper side of the sheet housing unit along the downstream-side end portions of the lift plate, and includes a pickup roller for abutting on a top surface of the sheet located at the uppermost position in the plurality of sheets to deliver the sheet;

the elevating mechanism includes a pair of first wires located outside the pair of first sidewalls in the second direction, the pair of first wires suspending the downstream-side end portions of the lift plate at both sides in the second direction of the lift plate, a pair of second wires located outside the pair of first sidewalls in the second direction, the pair of second wires suspending the upstream-side end portions of the lift plate at both sides in the second direction of the lift plate, a pair of first pulleys where the pair of first wires is laid across the first pulleys being arranged on the first sidewalls vertically below the pickup roller, viewed from the second direction, a pair of second pulleys where the pair of second wires is laid across, a motor-driven reel for winding up the pair of first wires and the pair of second wires to a predetermined point where the downstream-side end portions of the lift plate are near the pair of first pulleys, and a pair of first connecting members coupling the downstream-side end portions of the lift plate to the first wires to be movable vertically relative to the first wires, in a connection counterbalanced such that the lift plate is caused to move upward, bringing the top surface of the sheet located at the uppermost position in the plurality of sheets into abutment against the pickup roller, when the weight of the plurality of sheets that the lift plate carries is lighter than a predetermined value based on the sheets' weight at the predetermined point where the downstream-side end portions of the lift plate are near the pair of first pulleys.

2. The sheet feeder according to claim 1, wherein:

the lift plate includes a cut-out portion between the upstream-side end portions and the downstream-side end portions; and the side fence is located in the cut-out portion.

3. The sheet feeder according to claim 1, wherein the elevating mechanism further includes a pair of second connecting members that connect the upstream side end portions of the lift plate to the second wires.

4. The sheet feeder according to claim 1, wherein the pair of first connecting members each include a wire connecting member that is mounted to the lift plate and is relatively movable in a vertical direction with respect to the lift plate and a biasing member that is located between the wire connecting member and the lift plate and biases the lift plate upward.

5. The sheet feeder according to claim 4, wherein the wire connecting member includes:

a mounting portion formed to have a guide groove vertically extending;

a wire connecting portion that extends outward in the second direction in a lower side of the guide groove of the mounting portion and connects to the first wire or the second wire;

a spring-securing portion that extends inward in the second direction and secures the biasing member; and a connection pin that is inserted into the guide groove and is secured to the lift plate.

6. An image forming apparatus, comprising:

the sheet feeder according to claim 1; and an image forming unit that forms an image on the sheet fed from the sheet feeder.

7. A sheet feeder comprising:

an apparatus main body;

a sheet housing unit insertably and removably located on the apparatus main body, the sheet housing unit housing a plurality of sheets; and a sheet feeding unit for extracting in a first direction a sheet located at an uppermost position in the plurality of sheets; wherein the sheet housing unit includes a housing space that has an opening in an upper side, the housing space being defined by a bottom portion, a pair of first sidewalls that is located upright from the bottom portion and are mutually opposed in a second direction perpendicular to the first direction, and a pair of second sidewalls mutually opposed in the first direction, a lift plate for carrying the plurality of sheets, the lift plate having downstream-side end portions along an edge of the lift plate sheet-feeding downstream in the first direction, and the lift plate arranged for moving up and down inside the housing space, an elevating mechanism that causes the lift plate to move up and down, and a side fence located upright from the bottom portion, the side fence abutting on a side end of the plurality of sheets along the first direction;

the elevating mechanism includes a pair of first wires located outside the pair of first sidewalls in the second direction, the pair of first wires suspending end portions in a downstream side of the first direction of the lift plate at both sides in the second direction of the lift plate, a pair of second wires located outside the pair of first sidewalls in the second direction, the pair of second wires suspending end portions in an upstream side of the first direction of the lift plate at both sides in the second direction of the lift plate, a pair of first pulleys where the pair of first wires is laid across, a pair of second pulleys where the pair of second wires is laid across, a reel that winds up the pair of first wires and the pair of second wires, and a pair of first connecting members that connect the end portions in the downstream side of the first direction of the lift plate to the first wires; and the pair of first connecting members are connected to be relatively movable with respect to the lift plate in a vertical direction, to cause a relative position to vary with respect to the lift plate in a vertical direction in accordance with a weight of the plurality of sheets loaded on the lift plate, and cause the lift plate to move upward when the weight is lighter than a predetermined value, the pair of first connecting members each including a wire connecting member that is mounted to the lift plate and is relatively movable in a vertical direction with respect to the lift plate and including a biasing member that is located between the wire connecting member and the lift plate and biases the lift plate upward, and the wire connecting members each including a mounting portion formed to have a vertically extending guide groove, a wire connecting portion extending outward in the second direction at a lower side of the guide groove in the mounting portion, and connecting to the first wire or the second wire, a spring-securing portion that extends inward in the second direction and secures the biasing member, and a connection pin that is inserted into the guide groove and is secured to the lift plate.

* * * * *